US006687941B2

(12) United States Patent
Billat

(10) Patent No.: US 6,687,941 B2
(45) Date of Patent: Feb. 10, 2004

(54) DEVICE FOR SIMULTANEOUSLY CLEANING AND DRYING SURFACES MADE OF GLASS AND OTHER MATERIALS

(76) Inventor: Alain Edouard Billat, 16 rue Michel Bléré, Lamorlaye (FR)

( * ) Notice: Subject to any disclaimer, the term of this patent is extended or adjusted under 35 U.S.C. 154(b) by 0 days.

(21) Appl. No.: 10/350,263

(22) Filed: Jan. 24, 2003

(65) Prior Publication Data

US 2003/0159226 A1 Aug. 28, 2003

Related U.S. Application Data

(63) Continuation-in-part of application No. 09/545,607, filed on Apr. 7, 2000, now abandoned.

(30) Foreign Application Priority Data

Apr. 9, 1999 (FR) ..... 99 04467

(51) Int. Cl.[7] ..... A47L 1/06

(52) U.S. Cl. ..... 15/220.1; 15/104.94; 15/209.1; 15/228; 15/244.3

(58) Field of Search ..... 15/104.94, 209.1, 15/210.1, 220.1, 228, 231, 232, 244.3

(56) References Cited

U.S. PATENT DOCUMENTS

| | | | | |
|---|---|---|---|---|
| 3,711,889 | A | 1/1973 | Jennings | 15/227 |
| 4,729,143 | A | 3/1988 | Dawson | 15/210.1 |
| 4,961,242 | A | 10/1990 | Kresse et al. | 15/228 |
| 5,066,527 | A | 11/1991 | Newell | 428/35.6 |
| 5,333,347 | A | 8/1994 | Stranders | 15/220.1 |
| 5,419,015 | A | 5/1995 | Garcia | 15/228 |
| 5,596,787 | A | 1/1997 | Stevens et al. | 15/220.1 |
| 5,609,255 | A | 3/1997 | Nichols | 206/576 |
| 5,657,507 | A | 8/1997 | Wasak | 15/220.1 |
| 5,862,565 | A | 1/1999 | Lundstedt | 15/220.1 |
| 5,970,560 | A | 10/1999 | Leroux | 15/121 |
| 5,979,003 | A | 11/1999 | Billat | 15/104.94 |
| 6,000,087 | A | 12/1999 | Petner | 15/119.2 |

FOREIGN PATENT DOCUMENTS

| | | |
|---|---|---|
| EP | 149705 | 7/1985 |
| EP | 458655 | 11/1991 |

*Primary Examiner*—Mark Spisich
(74) *Attorney, Agent, or Firm*—Browdy and Neimark, P.L.L.C.

(57) ABSTRACT

A cleaning device composed of a rigid or semi-rigid plate and a substantially flat cleaning pad removably fixed to the plate. The cleaning pad is composed of: a first layer made of light non-woven material, forming the outer face of the pad and having a first permeability to an aqueous liquid, a first thickness, a first capacity of absorption of the aqueous liquid, and abrasive properties; a second layer made of a blotting material, adjacent to the first layer and having a second permeability lower than the first permeability, a second thickness greater than the first thickness, and a second capacity of absorption; a third layer made of a dense hydrophilic material, adjacent to the second layer and having a third permeability, a third thickness, and a third capacity of absorption higher than the second capacity of absorption; and a fourth layer made of a liquid impermeable film.

15 Claims, 1 Drawing Sheet

DEVICE FOR SIMULTANEOUSLY CLEANING AND DRYING SURFACES MADE OF GLASS AND OTHER MATERIALS

CROSS REFERENCE TO RELATED APPLICATION

This a continuation-in-part of application Ser. No. 09/545,607, filed Apr. 7, 2000, abandoned.

BACKGROUND OF THE INVENTION

The present invention relates to a device for simultaneously cleaning and drying surfaces of glass and other materials. The invention is particularly applicable to the cleaning of automobiles windows, shop windows and windows in the home.

It is common practice to clean such a surface by: spraying a cleaning liquid thereon; wiping the glass surface with a cloth or pad so as to spread the cleaning liquid and to collect soil from the surface; and then drying the surface with a separate, clean and dry woven material.

Furthermore, when cleaning the interior surface of an automobile windshield by spraying liquid directly onto the windshield, the liquid spray cannot be confined to the windshield and a certain portion drops on to the vehicle dashboard, requiring that both the windshield and the dashboard be wiped.

Cleaning devices are also known that include a rigid or semi-rigid plate having one face provided with a gripping means and an outer face provided with a cleaning material. However, the known devices of this type do not permit an effective and speedy cleaning operation and tend to be relatively costly.

BRIEF SUMMARY OF THE INVENTION

The present invention provides an improved cleaning device composed essentially of: a rigid or semi-rigid plate with first and second opposite faces; gripping means secured to the first face of the plate; reusable fixation means; and a substantially flat cleaning pad having inner and outer faces, the inner face of the pad being removably fixed onto the second face of the plate by the reusable fixation means. The cleaning pad is composed of:

- a first layer made of light non-woven material, the first layer forming the outer face of the pad and having a first permeability to an aqueous liquid, a first thickness, a first capacity of absorption of the aqueous liquid, and abrasive properties,
- a second layer made of a blotting material, adjacent to the first layer and having a second permeability lower than the first permeability, a second thickness greater than the first thickness, and a second capacity of absorption,
- a third layer made of a dense hydrophilic material, adjacent to the second layer and having a third permeability, a third thickness, and a third capacity of absorption higher than the second capacity of absorption, and
- a fourth layer made of a liquid impermeable film.

The first and fourth layers have outer borders that protrude beyond the second and third layers and the first and forth layers are joined together at the outer borders to form a closed pocket that encloses the second and third layers. Thus, a pressure applied onto the gripping means is transmitted through the plate to the outer face of the pad, achieving simultaneous cleaning and drying of window panes, pieces of furniture and similar articles.

DETAILED DESCRIPTION OF THE INVENTION

Figure 1:
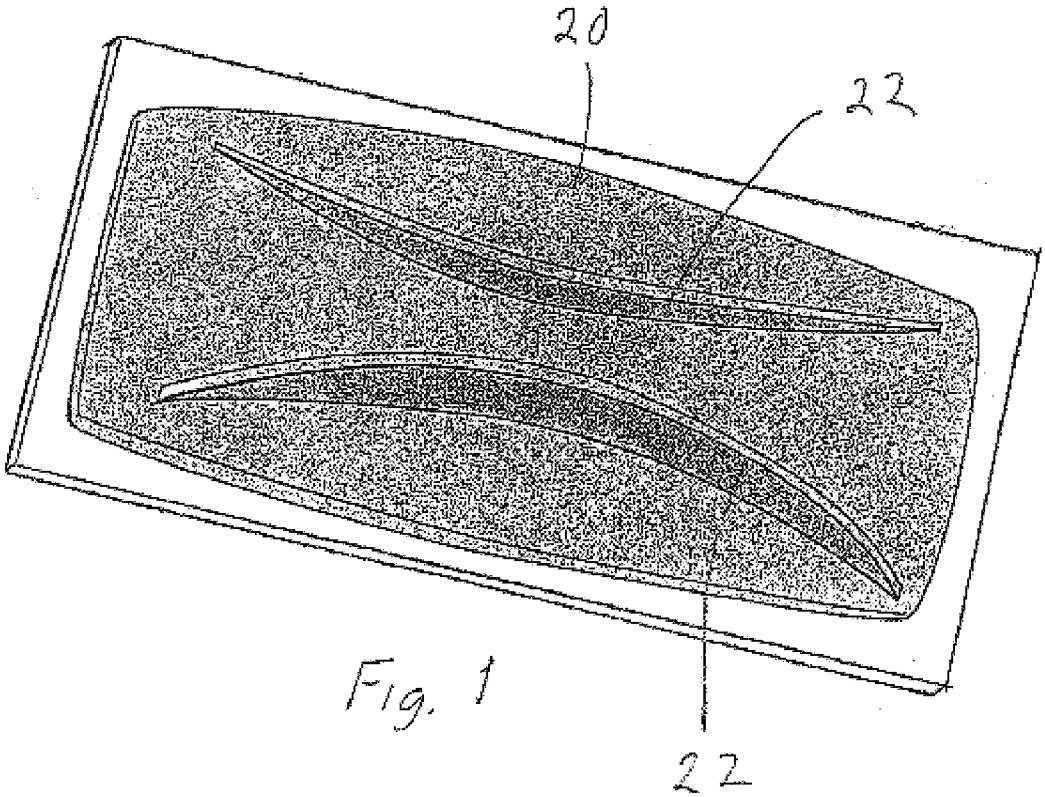
FIG. 1 is an perspective view of one embodiment of a cleaning device according to the invention.

As shown in FIG. 1, the cleaning device according to the present invention is composed of a rigid or semi-rigid plate 20 with first and second opposite faces and a gripping means 22 in the form of two raised strips that are secured to, or integral with, the first face of plate 20. The gripping means can, of course, have other forms.

Figure 2:
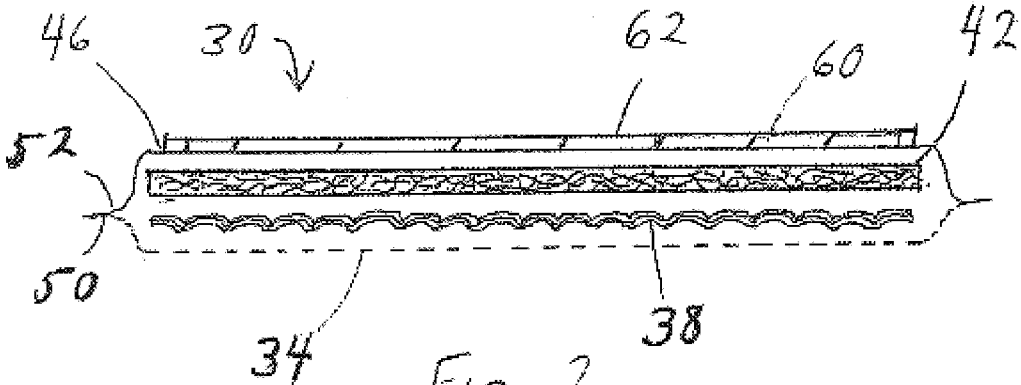
FIG. 2 is a cross-sectional view of the pad component of the device of FIG. 1.

As shown in FIG. 2, the cleaning device according to the present invention is further composed of a substantially flat cleaning pad 30 having inner and outer faces, the inner face of the pad being removably fixed onto the second face of the plate by reusable fixation means, to be described below.

Cleaning pad 30 includes the following components:

- a first layer 34 made of light, porous non-woven material, the first layer forming the outer face of the pad and having a first permeability to an aqueous liquid, a first thickness, a first capacity of absorption of the aqueous liquid, and abrasive properties,
- a second layer 38 made of a blotting material, adjacent to first layer 34 and having a second permeability lower than the first permeability, a second thickness greater than the first thickness, and a second capacity of absorption,
- a third layer 42 made of a dense hydrophilic material, adjacent to second layer 38 and having a third permeability, a third thickness, and a third capacity of absorption higher than the second capacity of absorption, and
- a fourth layer 46 made of an impervious film adjacent to third layer 42.

First and fourth layers 34 and 46 have respective outer borders, or edges, 50 and 52 that extend beyond layers 38 and 42 and that are bound together, as by means of a permanent adhesive or thermowelding. Thus, layers 34 and 46 form a closed pocket that encloses layers 38 and 42.

In FIG. 2, layers 34, 38, 42 and 46 are shown separated from one another to better illustrate the form of each layer. In an actual device according to the invention, these layers will be in contact with one another.

The reusable fixation means may be a sheet or layer 60 of an adhesive material applied onto the external face of layer 46, as shown in FIG. 2, or a sheet or layer of a similar adhesive material applied onto the second face of plate 20 (not visible in FIG. 1). Prior to joining plate 20 to pad 30, the adhesive material may be protected by a removable protective tape 62. Alternatively, the reusable fixation means is made of a hook and loop fastener, one component of which is secured to the external face of layer 46 and the other component of which is secured to the second face of plate 20.

Preferably, first layer 34 is made of polypropylene or polyester agglomerated fibers, preferably having a basis unit weight lower than 30 g/m$^2$.

Preferably, second layer 38 has a basis unit weight higher than 150 g/square meter, the second thickness is at least equal to 0.5 millimeter, the second capacity of absorption is at least equal to 3 grams of water per gram of material of the second layer.

Also preferably, second layer 38 is embossed to have protruding first distributed areas in contact with first layer 34. The embossing creates, on the opposite side of layer 38, second distributed areas in contact with third layer 42. According to preferred embodiments of the invention, the first distributed areas in contact with first layer 34 are distributed over the whole surface of second layer 38 according to a regular pattern and cover at most 33% of the surface of second layer 38.

The protruding first distributed areas, which are in contact with first layer 34, serve to reduce the total area of the surface of first layer 34 that is in intimate contact with the surface to be cleaned, so that the device can more easily slide along that surface. At the same time, the protruding first distributed areas either collect cleaning liquid, which flows through second layer 38 toward the second distributed areas and toward third layer 42 if the cleaning liquid has been first sprayed onto the surface to be cleaned, or they bring the cleaning liquid in the reverse direction from layer 42 to layer 34, in very small and regulated quantities, if the cleaning liquid has been initially sprayed onto the pad for subsequent application to the surface to be cleaned.

Also preferably, the third layer has a basis unit weight higher than 500 g/m$^2$ and is substantially rigid, the third thickness is at least equal to 1 millimeter, and the third capacity of absorption is at least equal to 7 grams of water per gram of material of the third layer.

Also preferably, the third thickness is greater than the second thickness, the second permeability is greater the third permeability, and the fourth layer is a sheet of polymer film.

Each layer of a pad according to the invention can have a basis unit weight, a thickness and/or a capacity of absorption higher than the values cited above, resulting in greater pad weight, thickness and/or absorption capacity, respectively. For practical purposes relating to cost and convenience, it is preferable to limit the maximum for each value to twice that specified above.

According to one exemplary practical embodiment of the invention: layer 34 is made of a non-woven voile, or sheet, of hydrophilic polypropylene film having a basis unit weight of 18 g/m$^2$ and sold by the Italian Company Fiberweb Neuberger SpA under the reference Base X1/18-X101801210-Laben; layer 38 is made of a 100% cellulose product sold by the Italian Company Magic S.R.L. under the reference 9V09A-RD118.09.00; layer 42 is made of a pulp product sold by the Finnish Company Metsa Serla under the reference 2938/220200; and layer 46 is a 30 $\mu$m thick film of polypropylene sold under the reference OPPalyte MD 447 by Exxon Mobil Chemical.

Cleaning of a surface with the device according to the present invention can be performed either by spraying the cleaning liquid onto the surface to be cleaned, or by applying the cleaning liquid onto the pad of the device. In either case, the surface is then wiped with the device. It has been found that with a device having a pad composed of the arrangement of layers according to the invention, wiping of the surface will simultaneously spread the cleaning liquid over the surface to be cleaned, collect soil, and dry the surface to be cleaned.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A cleaning device comprising: a rigid or semi-rigid plate with first and second opposite faces; gripping means secured to said first face of said plate; reusable fixation means; and a substantially flat cleaning pad having inner and outer faces, the inner face of said pad being removably fixed onto said second face of said plate by said reusable fixation means, wherein said cleaning pad comprises:

a first layer made of light non-woven material, said first layer forming the outer face of said pad and having a first permeability to an aqueous liquid, a first thickness, a first capacity of absorption of said aqueous liquid, and abrasive properties, a second layer made of a blotting material, adjacent to said first layer and having a second permeability lower than said first permeability, a second thickness greater than said first thickness, and a second capacity of absorption, a third layer made of a dense hydrophilic material, adjacent to said second layer and having a third permeability, a third thickness, and a third capacity of absorption higher than said second capacity of absorption, and a fourth layer made of a liquid impermeable film, wherein said first and fourth layers have outer borders that protrude beyond said second and third layers and said first and forth layers are joined together at said outer borders to form a closed pocket that encloses said second and third layers, and whereby a pressure applied onto said gripping means is transmitted through said plate to said outer face of said pad, achieving simultaneous cleaning and drying of window panes, pieces of furniture and similar articles.

2. The cleaning device as set forth in claim 1, wherein said second layer is embossed and has first distributed areas in contact with said first layer, and second distributed areas in contact with said third layer.

3. The cleaning device as set forth in claim 2, wherein said third thickness is greater than said second thickness.

4. The cleaning device as set forth in claim 2, wherein said second permeability is higher than said third permeability.

5. The cleaning device as set forth in claim 2, wherein said first distributed areas are distributed over the whole surface of said second layer according to a regular pattern and cover at most 33% of the surface of said second layer.

6. The cleaning device as set forth in claim 5, wherein said fourth layer is a sheet of polymer film.

7. The cleaning device as set forth in claim 6, wherein said reusable fixation means comprises an adhesive material initially applied onto the inner face of said pad or the second face of said plate.

8. The cleaning device as set forth in claim 6, wherein said reusable fixation means comprises an adhesive material that is protected, before fixing said pad to said plate, by a removable protective tape.

9. The cleaning device as set forth in claim 5, wherein said reusable fixation means comprises a hook and loop fastener.

10. The cleaning device as set forth in claim 1, wherein said second layer is made of cellulose.

11. The cleaning device as set forth in claim 1, wherein said third layer is made of wood pulp.

12. The cleaning device as set forth in claim 1, wherein said first layer is made of polypropylene or polyester agglomerated fibers.

13. The cleaning device as set forth in claim 1, wherein said first layer has a basis weight lower than 30 $g/m^2$.

14. The cleaning device as set forth in claim 1, wherein said second layer has a basis weight higher than 150 $g/m^2$, the second thickness is at least equal to 0.5 millimeter, and the second capacity of absorption is at least equal to 3 grams of water per gram of material of said second layer.

15. The cleaning device as set forth in claim 1, wherein said third layer has a basis weight higher than 500 $g/m^2$ and is substantially rigid, the third thickness is at least equal to 1 millimeter, and the third capacity of absorption is at least equal to 7 grams of water per gram of material of said third layer.

* * * * *